United States Patent [19]

Spademan

[11] Patent Number: 4,602,443

[45] Date of Patent: Jul. 29, 1986

[54] SKI BOOT

[76] Inventor: Richard G. Spademan, 130 Country Club Dr. #30, Incline Village, Nev. 89450

[21] Appl. No.: 469,175

[22] Filed: Feb. 23, 1983

[51] Int. Cl.[4] ..... A43B 5/04

[52] U.S. Cl. ..... 36/120; 36/121

[58] Field of Search ..... 36/117–121

[56] References Cited

U.S. PATENT DOCUMENTS

| | | | |
|---|---|---|---|
| 4,280,286 | 7/1981 | Sartor | 36/118 |
| 4,455,768 | 6/1984 | Salomon | 36/121 |

FOREIGN PATENT DOCUMENTS

| | | | |
|---|---|---|---|
| 0053340 | 6/1982 | European Pat. Off. | 36/120 |
| 2000303 | 7/1971 | Fed. Rep. of Germany | 36/121 |
| 3218256 | 12/1982 | Fed. Rep. of Germany | 36/120 |
| 3219772 | 1/1983 | Fed. Rep. of Germany | 36/120 |

*Primary Examiner*—James Kee Chi

*Attorney, Agent, or Firm*—Townsend and Townsend

[57] ABSTRACT

A ski boot having a cuff movably mounted to a lower shell at two or more mounting points. The mounting points each include a protrusion guided along an elongate path to allow a combination of relative pivotal and linear movement between the cuff and shell. The paths, typically slots, are located and configured so that the lower leading edge of the cuff moves along a path generally parallel to the instep of the lower shell. A connector can be mounted to and between the lower shell and the cuff to limit rearward movement of the front cuff to one or more positions corresponding to optimum initial angles of the user's lower leg. The connector can also include a spring to resist forward movement of the cuff.

24 Claims, 14 Drawing Figures

SKI BOOT

BACKGROUND OF THE INVENTION

Ski boots are often made so that the cuff, surrounding the user's ankle and lower leg, can pivot a relatively small amount forwardly and rearwardly with respect to the lower shell housing the user's foot. The pivoted cuffs thus allow the user to make the necessary small adjustments to their forward lean while skiing. However, when conventional pivoted cuffs pivot forwardly beyond some normal setting, the lower, leading edge of the cuff becomes jammed against the instep of the lower shell. This causes distortion of both the cuff and the shell tending to flatten out the shell so that it presses against the user's foot.

SUMMARY OF THE INVENTION

The present invention is directed to a ski boot having a cuff slidably mounted to the lower shell at two or more mounting points. The cuff may be a single piece, wrap-around cuff or a multi-part, typically two piece, cuff. In the various embodiments the mounting points defined elongate paths allowing movement of the cuff relative to the lower shell. The elongate paths are typically, but need not be, defined by slots formed within the cuff or the lower shell, or both.

The mounting points and the adjacent, sliding surfaces of the cuff and lower shell are configured to allow the cuff to move forwardly along a complex path so that the leading edge of the cuff moves parallel to the upper instep surface of the lower shell. This complex forward motion of the cuff can be thought of as a combination of forward pivotal movement plus forward linear movement. The forward pivotal movement accommodates the forward flexion of the user's leg while the forward linear movement keeps the leading lower edge of the cuff from being jammed against the instep surface of the lower shell. As used in this application forwardly will mean toward the toe of the boot and rearwardly toward the heel.

In a first embodiment of the invention two primary mounting points movably couple the cuff to the lower shell on either side of the boot in the region near, and generally below, the user's ankle. One or more secondary mounting points are located between the primary mounting points, typically near the instep of the lower shell. A second embodiment of the invention uses only two mounting points. The primary mounting point is located at the heel and secondary mounting point at the instep. A third embodiment uses a pair of primary mounting points, located on the sides of the boot generally above the ankle, for movably coupling the cuff to the lower shell.

The movable connections at the primary mounting points are typically achieved by the engagement of a protrusion, such as a rivet, extending between the cuff and the lower shell. The protrusions pass through slots formed in either the cuff or the lower shell, or both, to allow the desired relative movement between the cuff and shell. The movable connections at the secondary mounting points are also typically achieved through a protrusion-slot arrangement. However, a guide, having a rearwardly extending overhang defining a gap within which a front edge of the cuff can slide, can be used instead.

The cuff may be of a two-piece design including a front cuff, mounted to the lower shell as described above, and rear cuff. The rear cuff is typically mounted to the lower shell at the primary mounting points. The rear cuff may include a slot at the primary mounting points to allow both pivotal and linear movement of the rear cuff; alternatively the rear cuff may be mounted to the lower shell to pivot about the protrusions at the primary mounting points.

A connecter can be mounted between the instep surface of the lower shell and the leading edge of the cuff to limit rearward movement of the cuff to one or more positions corresponding to one or more optimum initial angles for the user's lower leg. The connector can also include a spring to resist a certain amount of forward movement of the cuff. Placement of the connector on the instep allows the user convenient access to the connector for adjustment of the optimum initial angle or the spring tension.

A primary feature of the present invention is the connection of the cuff and lower shell in a manner so that the movement of the cuff is neither purely linear nor purely pivotal. This feature allows the leading edge of the cuff to move parallel to the instep surface of the lower shell during forward and rearward movement of the cuff. Thus, necessary changes in angulation of the user's lower leg can occur while maintaining a close fit between the leading edge of the cuff and the instep surface of the lower shell. This complex movement of the cuff prevents crushing deformation of the lower shell by the cuff during its forward movement. In addition, since a large initial gap between the leading edge and the instep surface is eliminated, problems with snow clogging such gap are avoided.

Other features and advantages of the present invention will appear from the following description in which the preferred embodiments have been set forth in detail in conjunction with the accompanying drawings.

DETAILED DESCRIPTION OF THE PREFERRED EMBODIMENTS

Figure 1:
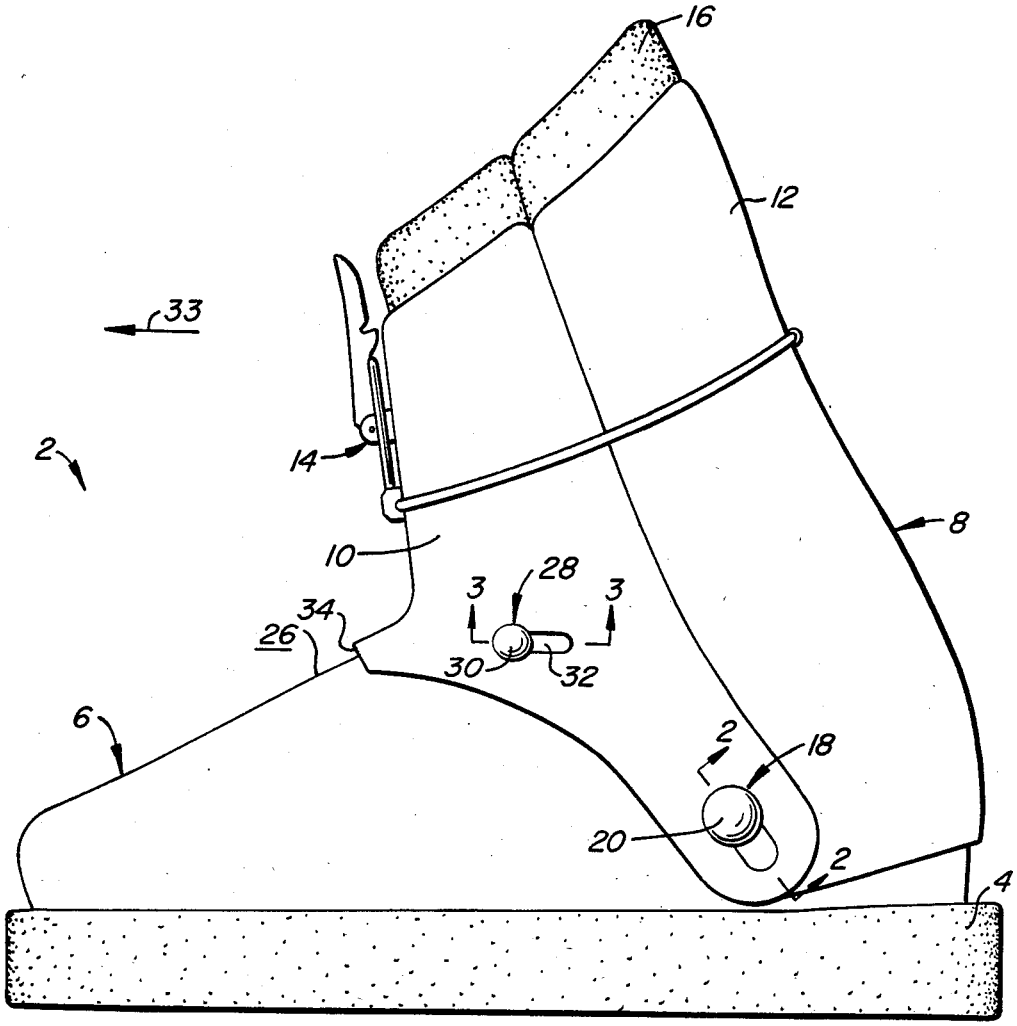
FIG. 1 is a side view of a first embodiment of the ski boot of the invention with the cuff in an initial forward lean position.
Figure 2:
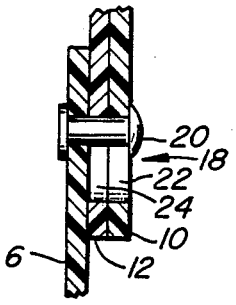
FIG. 2 is a sectional view taken along line 2—2 in FIG. 1 at the primary mounting point.

Referring now to FIGS. 1 and 2, a first, preferred embodiment of ski boot 2 is shown and includes generally a sole 4, to which a lower shell 6 is mounted, and a cuff assembly 8 movably mounted to the lower shell. Cuff assembly 8 includes generally a front cuff 10 and a rear cuff 12 pulled together by a buckle assembly 14. Loosening buckle assembly 14 allows front and rear cuffs 10, 12 to separate allowing the user to insert his or her foot into boot 2. A liner 16 insulates and cushions the user's foot and lower leg.

Boot 2 includes a primary mounting point 18 located on either side of the boot, typically in the region near the user's ankle. As shown in FIG. 2, a rivet 20 connects lower shell 6, rear cuff 10 and front cuff 12 at point 18. Rivet 20 is fixed in position with respect to shell 6 because it is mounted through a complementarily sized hole in shell 6. However, front and rear cuffs 10, 12 can both pivot about rivet 20 and move along slots 22, 24. Thus the movement of cuff assembly 8 relative to primary mounting point 18 can be considered to be both pivotal, to accommodate the normal forward lean of the user's leg, and linear, to keep front cuff 10 from being jammed against the instep surface 26 of lower shell 6 as is described in more detail below. If desired rivet 20 may be replaced with a bolt and nut to permit the friction between cuff assembly 8 and lower shell 6 to be adjusted. Changing the friction would change the opposition exerted by cuff assembly 8 to the forward and rearward lean of the user's leg.

Figure 3:
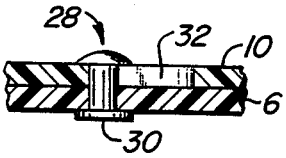
FIG. 3 is a sectional view taken along line 3—3 in FIG. 1 at the secondary mounting point.

Referring now also to FIG. 3, the pivotal and linear movement of front cuff 10 allowed by primary mounting point 18 is restricted by a secondary mounting point 28 mounted on either side of boot 2. Point 28 includes a rivet 30 which couples front cuff 10 to lower shell 6. Rivet 30 passes through a complementarily sized hole within lower shell 6 and an elongate slot 32 in front cuff 10. Slots 22, 24 and 32 are sized and positioned to allow both pivotal and linear movement of front cuff 10 with respect to lower shell 6 in response to the forward and rearward angular inclination of the user's lower leg. The slots are configured and located so that when the user bends his or her lower leg from a normal, initial forward lean, represented by boot 2 in FIG. 1, to a maximum forward lean, in the direction of arrow 33 and represented by the boot shown in FIG. 4, front cuff 10 pivots forwardly and also moves forwardly along a linear path. The combined pivotal and linear movement allows the lower leading edge 34 of front cuff 10 to remain generally adjacent to instep surface 26 as it moves parallel to surface 26. The crushing force normally encountered with conventional ski boots with pivoted cuffs is effectively eliminated.

Figure 4:
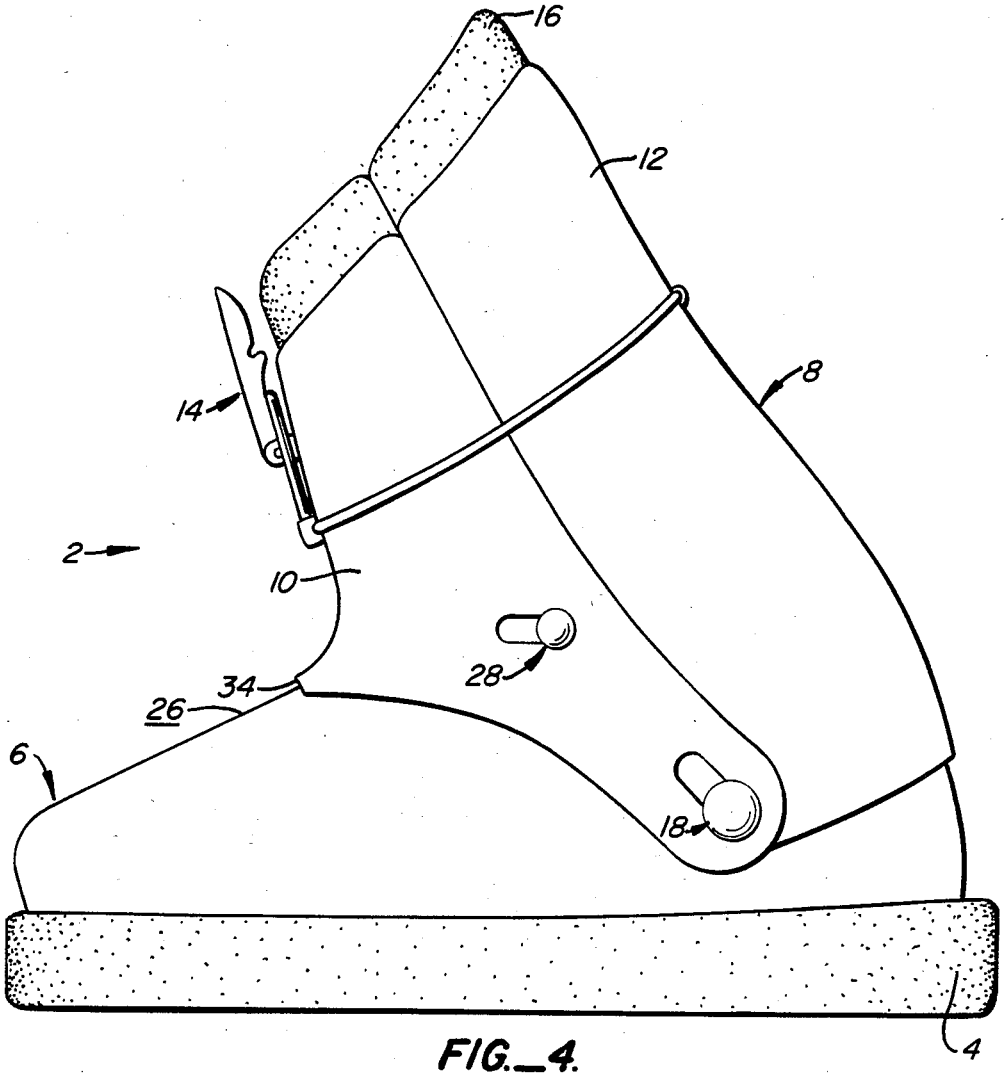
FIG. 4 shows the ski boot of FIG. 1 with the cuff in a fully forward position.

As indicated in FIGS. 1 and 4, the extent of movement of cuff assembly 8 from an initial position, correspondin9 to an initial forward lean of the user's lower leg (FIG. 1), to a fully forward position, corresponding to the maximum forward lean of the user's lower leg (FIG. 4), is limited by the engagement of rivets 20, 30 against the ends of slots 22, 24 and 32.

Figure 3B:
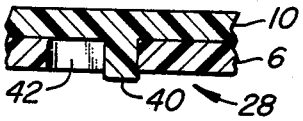
FIGS. 3A and 3B show alternative secondary mounting points.
Figure 3A:
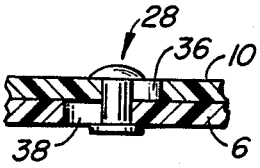

FIG. 3A shows an alternative embodiment of secondary mounting point 28 in which rivet 30 passes through slots 36, 38 formed in front cuff 10 and lower shell 6 respectively. FIG. 3B discloses a further embodiment of secondary mounting point 28 including an inwardly extending projection 40 extending from front cuff 10 to a slot 42 in shell 6.

The slots discussed thus far have been straight. The configuration of the slots can depend upon the location of the mounting points and the shape of the adjacent surface of the lower shell and the cuff, particularly at the instep and the heel. For example, a curved slot 44, shown in FIG. 5, may be used in lieu of straight slot 32 wih some boot designs.

Figure 6:
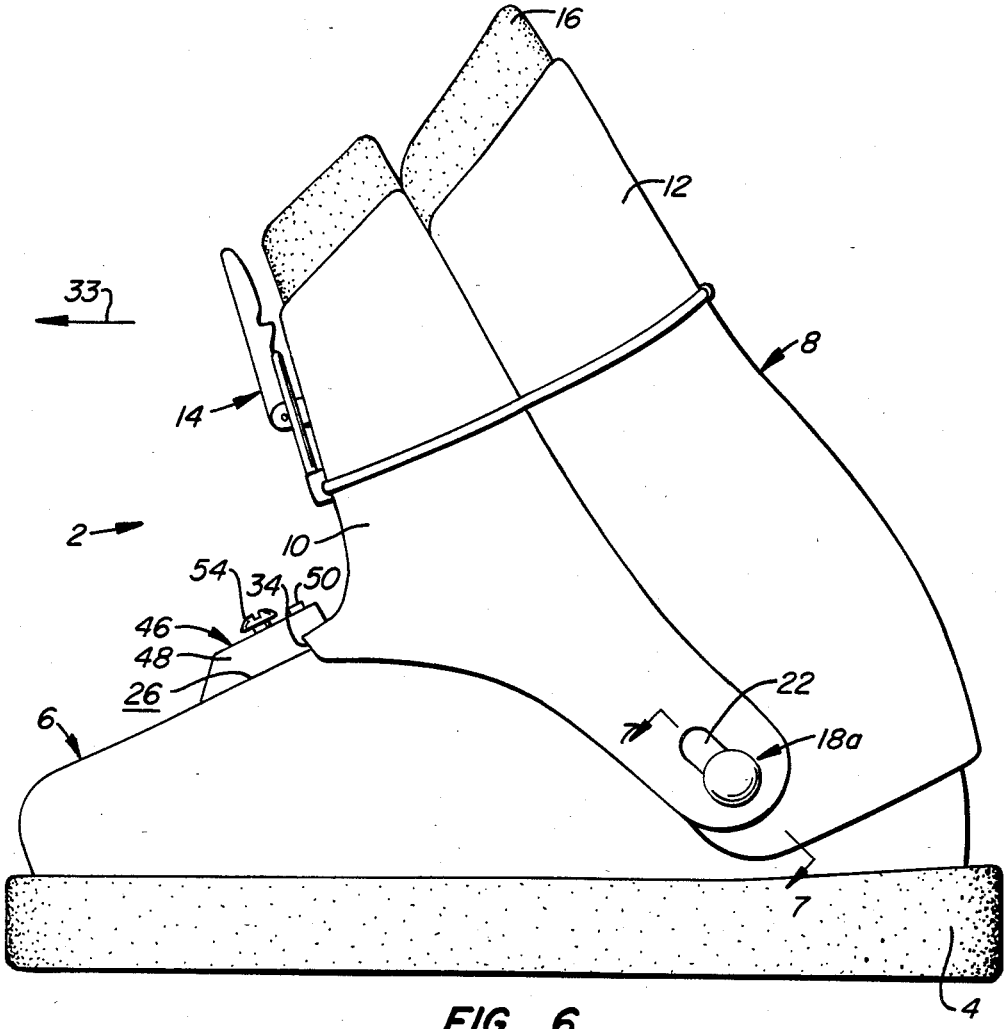
FIG. 6 shows an alternative embodiment of the ski boot of FIG. 4.
Figure 7:
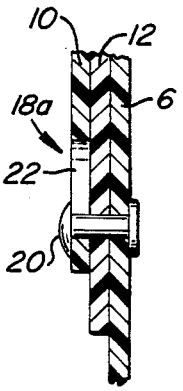
FIG. 7 is a cross-sectional view taken along 7—7 of FIG. 6 a the primary mounting point.

FIG. 6 discloses an alternative embodiment of the boot of FIG. 1. In this embodiment rear cuff 12, as shown in FIG. 7, lacks a slot 24 at primary mounting point 18*a*. Rather, rivet 20 passes through complementary holes within both shell 6 and rear cuff 12 and a slot 22 in front cuff 10. Thus, although front cuff 10 both pivots forwardly and moves linearly forwardly, rear cuff 12 only pivots forward. There is therefore a noticeable slippage of rear cuff 12 relative to front cuff 10 as shown by the displacement in the cuffs in FIG. 6.

Figure 8:
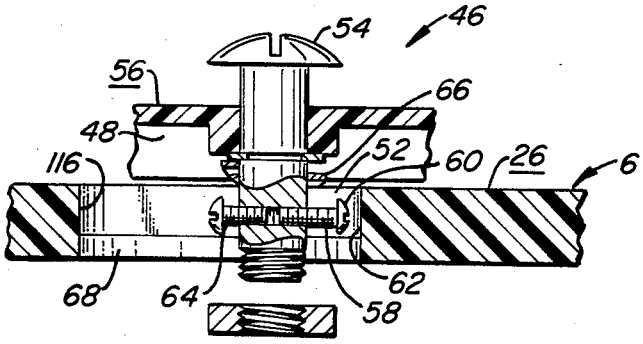
FIG. 8 is a cross-sectional view of the connector of FIG. 6.

Another distinction between the embodiment of FIG. 6 and that of FIG. 1 is the use of a connector 46 mounted to leading edge 34 of front cuff 10. Connector 46 is used in lieu of secondary mounting points 28 of FIG. 1 and acts as a single secondary mounting point to help guide leading edge 34 along a path parallel to instep surface 26. Referring now to FIG. 8, connector 46 includes a housing 48 mounted to leading edge 34 of front cuff 10 in a suitable manner, such as by pins 50. Housing 48 could also be molded as an integral extension of front cuff 10 if desired. Lower shell 6 includes a slot 52 formed within the lower shell along instep surface 26. A guide screw 54, mounted through the top surface 56 of housing 48 and passing through slot 52, guides connector 46 and lower leading edge 34 of front cuff 10 therewith along a path parallel to surface 26.

Connector 46, in addition to guiding the forward and rearward movement of front cuff 10, is also used to vary the initial position of the cuff assembly 8, and thus vary the initial forward lean of the user's lower leg. To do so an adjustment screw 58 is threadably mounted into the body of guide screw 54 and positioned so that its head 60 can contact the rearward end 62 of slot 52. Adjusting the position of screw 58 changes when head 60 contacts end 62 and thus changes when rearward movement of cuff assembly 8 is halted.

Connector 46 is constructed to permit a quick change between two different initial forward lean angles. To do so a second adjustment screw 64 is mounted into the body of screw 54 colinear with adjustment screw 58. The length of adjustment screws 58, 64 are different. To change the relative positions of adjustment screws 58 and 64, the user presses downwardly on guide screw 54 to compress spring washer 66 until adjustment screws 58, 64 move into the enlarged slot region 68 underlying slot 52. Guide screw 54 is then rotated 180° to switch the relative positions of adjustment screws 58 and 64 thus altering the initial position of cuff assembly 8. The fully forward position of cuff assembly 8 is limited by the length of slot 22 in front cuff 10.

Figure 9:
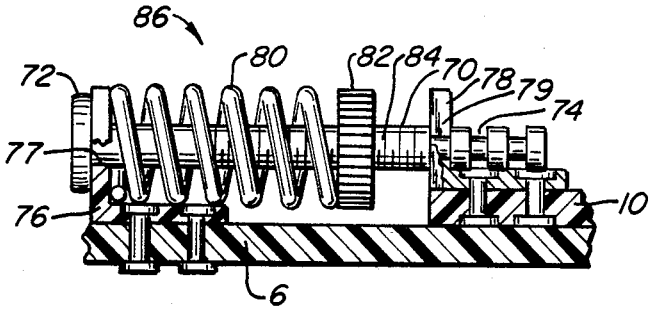
FIG. 9 is a cross-sectional view of an alternative embodiment of the connector of FIG. 8.

Referring now to FIG. 9, a connector 86, used in lieu of connector 46, is shown. Connector 86 includes an elongate rod 70 having an enlarged forward end 72 and a number of circumferential grooves 74 formed within its other end. Rod 70 is mounted to a pair of L-shaped brackets 76, 78 which are pinned to lower shell 6 and front cuff 10 respectively. Bracket 76 includes a circular hole 77 through which circular rod 70 passes. Bracket 78 includes an upwardly extending slot 79 sized to engage rod 70 at grooves 74. Connector 86 is shown as it would appear when cuff assembly 8 is in its initial, rearward position with enlarged end 72 abutting bracket 76. Thus it can be seen that changing groove 74 within slot 79 in bracket 78 changes the initial forward lean of the user's lower leg.

A spring 80 is captured between a threaded tension adjustor 82 and bracket 76. Spring 80 thus biases rod 70, and therefore cuff assembly 8, rearwardly. Changing the position of tension adjustor 82 along a threaded portion 84 of rod 70 changes the amount of resistance to forward movement connector 86 exerts on cuff assembly 8.

Figure 10:
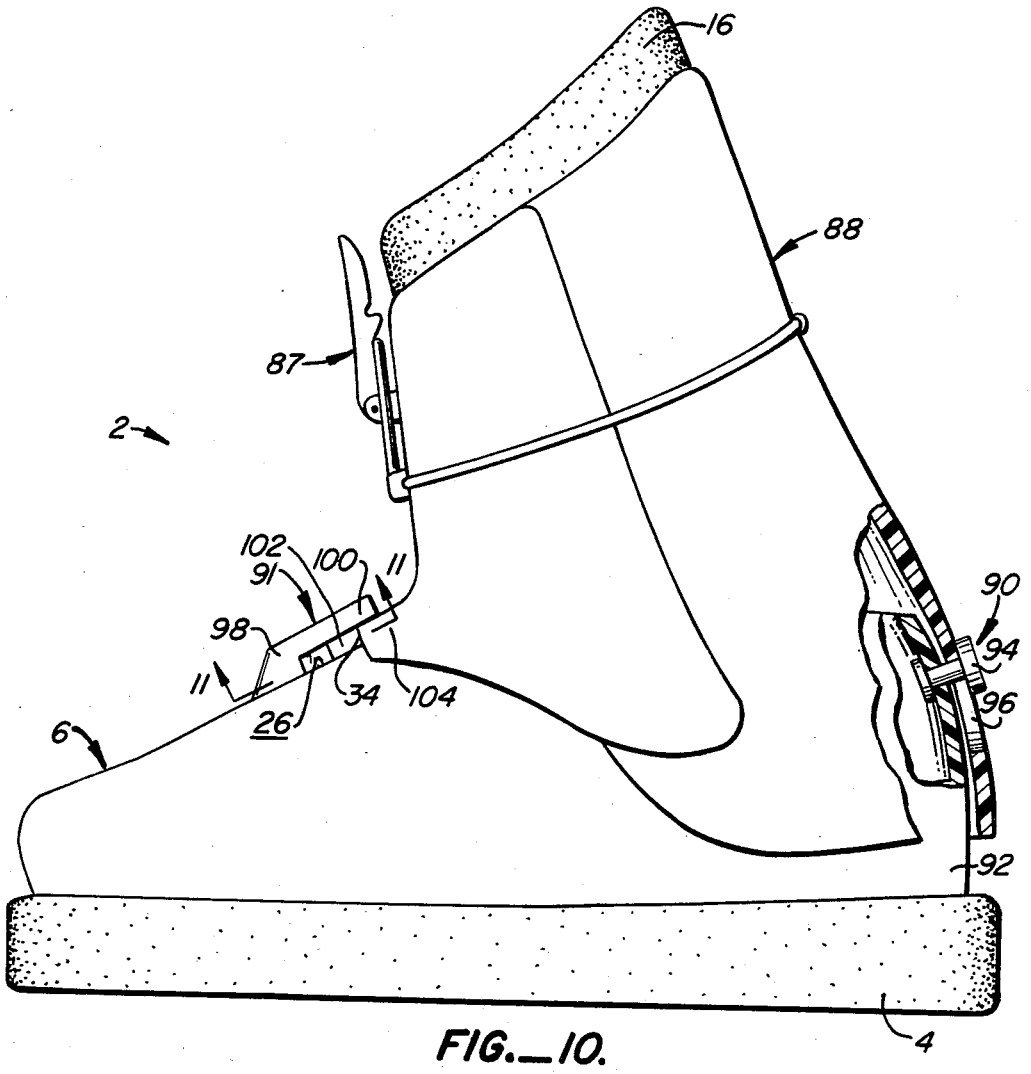
FIG. 10 is a side view of a second embodiment of the invention with the cuff in the initial forward lean position.
Figure 11:
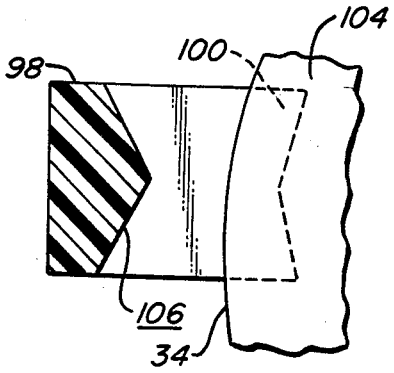
FIG. 11 is a bottom view of the guide taken along line 11—11 in FIG. 10.

Turning now to FIG. 10, a second embodiment, using only two mounting points, is illustrated. Shoe 2 of FIG. 10 includes a one-piece, wrap around cuff assembly 88 that is tightened with a buckle assembly 87. The cuff is movably secured to lower shell 6 at a primary mounting point 90 and a secondary mounting point 91. Primary mounting point 90, located at the heel 92 of lower shell 6, includes a rivet 94 mounted through a slot 96 in cuff assembly 88. Secondary mounting point 91 includes a guide 98, shown also in FIG. 11, rigidly mounted to surface 26, having an overhang 100 forming a rearwardly facing gap 102 above surface 26. Guide 98 may be mounted to lower shell 6 or may be molded as an integral part of the lower shell. Cuff assembly 88 has a forward lip 104 at edge 34 sized to slide parallel to surface 26 within gap 102. The initial and fully forward positions of cuff assembly 88 are determined by the length of slot 96. Gap 102, as shown in FIG. 11, is bounded by a V-shaped surface 106. Any snow caught between edge 34 and surface 106 is therefore pushed out of the gap when cuff assembly 88 moves forwardly.

Figure 12:
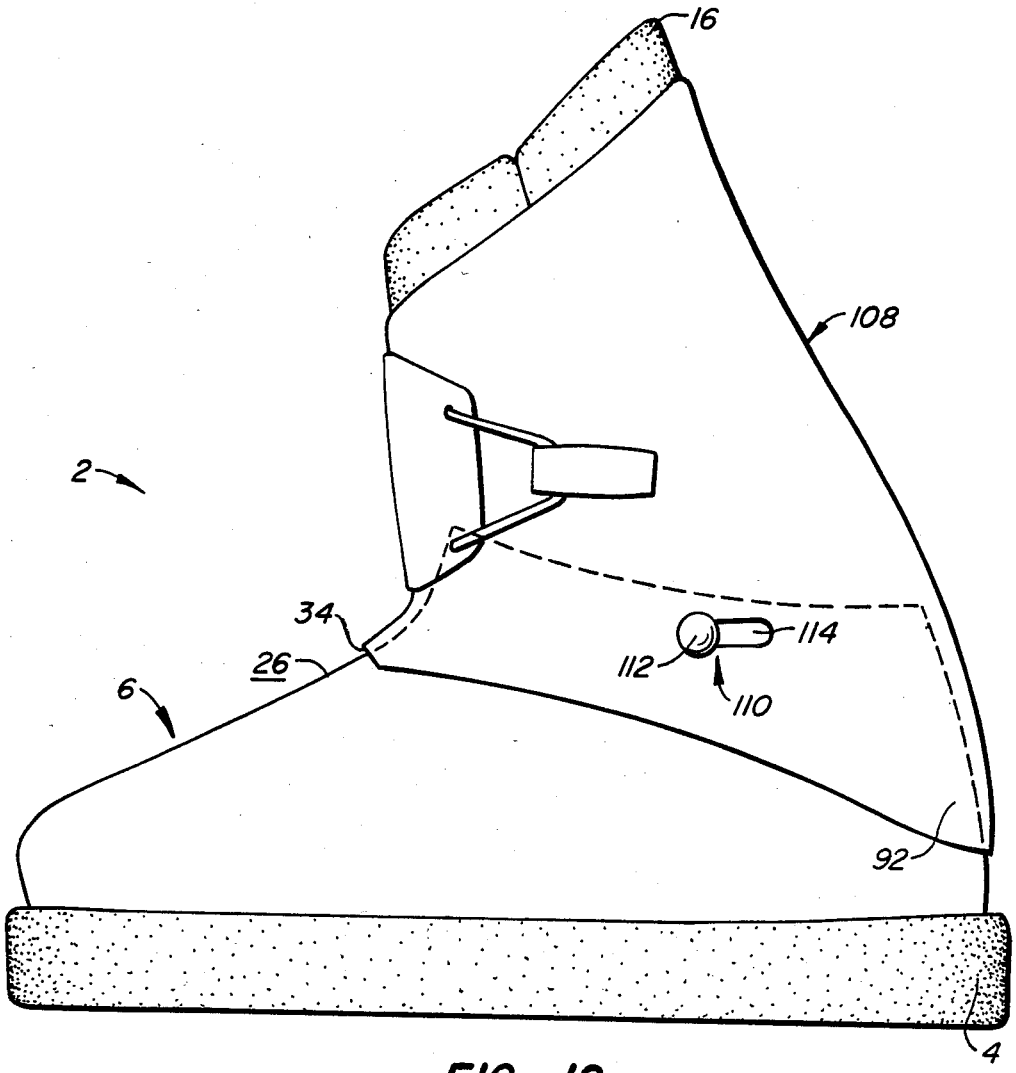
FIG. 12 is a side view of a third embodiment of the invention with the cuff in the initial forward lean position.

Referring now to FIG. 12, a third embodiment of the invention is disclosed. It is similar to the embodiment of FIG. 10 in that it uses a one-piece cuff assembly 108 mounted to lower shell 6 at only two mounting points 110. Mounting points 110 are similar in structure to mounting points 28 (see FIGS. 1 and 3) and include a rivet 112 mounted to lower shell 6 and passing through a slot 114 in cuff assembly 108. Points 110 are located on the lateral sides of boot 2 in the region of, and generally above, the user's ankle.

Figure 5:
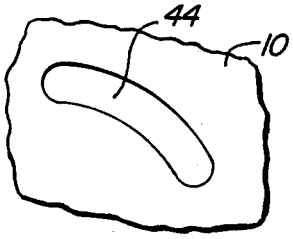
FIG. 5 shows a curved cuff slot.

The desired complex pivotal, linear motion is achieved by the location and configuration of slots 114 and also by the shape and inclination of surface 26 and of heel 92. Therefore forward movement of cuff assembly 108 is possible only with the simultaneous forward pivotal movement of the cuff assembly. Depending upon the location of points 110 and the shape of boot 2, a curved slot, such as shown in FIG. 5, may be used in lieu of the straight slot 114.

In the preferred embodiment of FIGS. 1 and 4 the forward lean of the skier past the maximum forward lean is resisted by rivets 20, 30 exerting compression forces on front cuff 10, rear cuff 12 and lower shell 6. This can be contrasted with the crushing forces exerted by the lower leading edge of the front cuff of prior art ski boots after some maximum angle of forward lean is reached. In the embodiment of FIG. 6 it may be desired to eliminate adjusting screw 64 and configure slot 52 so that guide screw 54 abuts a forward end 116 of slot 52 when cuff assembly is at its fully forward position. Even though forward cuff 10 will exert a force on lower shell 6, it is a compression force directed in a direction parallel to instep surface 26, not a crushing force exerted transverse to surface 26. It may also be desirable to include secondary mounting points 28 when using a connector 46 to limit forward lean of the user's lower leg.

Other modifications and variation can be made to the disclosed embodiments without departing from the subject of the invention as defined in the following claims.

I claim:

1. A sport shoe comprising a shell including an instep section; a cuff including a front segment; and means mounting the cuff to the shell so that the front segment overlies the instep section, the mounting means permitting relative movement along an elongate path between the cuff and shell at the mounting points and relative movement between the front segment of the cuff and the shell along a path which is substantially parallel to the instep section of the boot to prevent contact between the front segment and the instep section capable of deforming the front segment.

2. The sport shoe of claim 1 wherein said mounting means includes first and second mounting means.

3. The ski boot of claim 2 wherein said first and second mounting means are located on the lateral sides of said cuff.

4. The ski boot of claim 2 comprising at least two first mounting means located on the lateral sides of said cuff and a second mounting means located at the front segment of the cuff.

5. The ski boot of claim 1 wherein said mounting means includes a rivet and a slot formed in said cuff.

6. A sport shoe comprising a shell shaped to receive wearer's foot and including an instep section which overlies the instep of the foot; a cuff shaped to engage a portion of the wearer's lower leg and having a front segment which overlies the instep section in close proximity thereto; means movably mounting the cuff to the shell; and guide means operatively connected with the movably coupling means for guiding relative pivotal and linear movement between the cuff and the shell so that the front segment of the cuff moves substantially parallel to the instep section of the shell to prevent the front segment of the cuff from being deformed due to a forced contact with the instep section of the shell during relative cuff motions.

7. A ski boot comprising:

a sole;

a lower shell, having a heel and an upper instep surface, mounted to said sole for receipt of a user's foot;

a cuff assembly including a cuff having lateral sides and a leading edge configured to overlie said upper instep surface;

first and second means for movably mounting said cuff to said lower shell;

said first mounting means including a first, elongate path and also including first means for movable engagement within and along said first elongate path; and said second mounting means including a second elongate path and also including second means for movable engagement within and along said second elongate path, said first and second elongate paths being positioned and configured to guide forward and rearward movement of said cuff so said leading edge moves generally parallel to said upper instep surface during such forward and rearward movement.

8. The ski boot of claim 7 wherein said second movably mounting means includes a guide defining said second elongate path between a portion of said guide and said upper instep surface, and wherein said second movable engagement means includes a lip portion at said leading edge of said cuff configured for sliding engagement within said second elongate path.

9. The ski boot of claim 7 wherein said first mounting means is located at said heel of said lower shell.

10. The ski boot of claim 7 wherein said cuff includes a front cuff and a rear cuff, said ski boot further comprising third means for movably mounting said rear cuff to said lower shell, said third mounting means located on the lateral sides of said cuff.

11. The ski boot of claim 10 wherein said third mounting means includes means for pivotably mounting said rear cuff to said lower shell.

12. The ski boot of claim 10 wherein said third mounting means includes a third elongate path defined by said rear cuff and within which said first protrusion means moves.

13. The ski boot of claim 7 wherein said first elongate path is defined by said cuff.

14. The ski boot of claim 7 wherein said second mounting means includes a first slot in said cuff and a second slot in said lower shell.

15. The ski boot of claim 14 wherein said second movable engagement means includes a rivet mounted through said first and second slots.

16. The ski boot of claim 7 wherein said second elongate path includes an arcuate slot in said cuff.

17. The ski boot of claim 7 wherein said second mounting means includes at least two said second elongate paths and movable engagement means.

18. The ski boot of claim 7 further comprising means, operably coupling said lower shell and said cuff, for restricting rearward movement of said cuff to a chosen initial orientation relative to said lower shell.

19. The ski boot of claim 18 wherein said second mounting means includes said rearward movement restricting means.

20. The ski boot of claim 18 wherein said rearward movement restricting means includes a connector mounted to and operably coupling said upper instep surface of said lower shell and said cuff at said leading edge thereof.

21. The ski boot of claim 18 wherein said rearward movement restricting means includes means for varying said chosen orientation.

22. The ski boot of claim 18 wherein said rearward movement restricting means includes means for resiliently restraining forward movement of said cuff relative to said lower shell.

23. The ski boot of claim 7 further comprising means, operatively coupling said lower shell and said cuff, for resiliently restraining forward movement of said cuff relative to said lower shell.

24. A ski boot comprising:

a sole;

a lower shell, having an upper instep surface, mounted to said sole for receipt of a user's foot;

a cuff assembly having lateral sides and including a front cuff, having a leading edge and configured to overlie said upper instep surface, and a rear cuff;

first means for movably mounting said front cuff to said lower shell, one said first mounting means located on each of the lateral sides of said cuff assembly near the user's ankle, said first mounting means including a first elongate slot formed within said cuff assembly or said lower shell and also including first protrusion means for movable engagement within and along said first elongate slot;

said first mounting means including means for movably mounting said rear cuff to said lower shell; and second means for movably mounting said cuff to said lower shell, said second mounting means including a second elongate slot within said cuff or said lower shell and also including second protrusion means for movable engagement within and along said second elongate slot, said first and second elongate slots positioned and configured to guide forward and rearward movement of said cuff so said leading edge moves generally parallel to said upper instep surface during such forward and rearward movement.

* * * * *